US011557442B1

(12) United States Patent
Chan et al.

(10) Patent No.: US 11,557,442 B1
(45) Date of Patent: Jan. 17, 2023

(54) KEYBOARD DEVICE AND TOUCH KEY STRUCTURE THEREOF

(71) Applicant: Primax Electronics Ltd., Taipei (TW)

(72) Inventors: Chin-Lung Chan, Taipei (TW); Yi-Hsien Lin, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/695,593

(22) Filed: Mar. 15, 2022

(30) Foreign Application Priority Data

Dec. 29, 2021 (TW) ..... 110149451

(51) Int. Cl.

| | |
|---|---|
| ***H01H 3/12*** | (2006.01) |
| ***H01H 13/704*** | (2006.01) |
| ***H01H 13/04*** | (2006.01) |
| ***H01H 13/705*** | (2006.01) |

(52) U.S. Cl.
CPC ..... *H01H 3/125* (2013.01); *H01H 13/04* (2013.01); *H01H 13/704* (2013.01); *H01H 13/705* (2013.01); *H01H 2233/07* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 9,666,390 | B2 * | 5/2017 | Kim | G06F 3/0219 |
| 9,959,994 | B1 * | 5/2018 | Liu | H01H 13/78 |
| 10,656,727 | B2 * | 5/2020 | Chen | G06F 3/0233 |

* cited by examiner

*Primary Examiner* — Ahmed M Saeed
(74) *Attorney, Agent, or Firm* — Kirton McConkie; Evan R. Witt

(57) ABSTRACT

A keyboard device includes a circuit substrate, a control unit and plural touch key structures. The control unit is installed on the circuit substrate. Each touch key structure includes a base plate, a keycap, a connecting element and a touch-sensitive circuit layer. The base plate is detachably installed on the circuit substrate. The keycap is located over the base plate. The connecting element is arranged between the base plate and the keycap. The keycap is movable upwardly or downwardly relative to the base plate through the connecting element. The touch-sensitive circuit layer is arranged between the base plate and the keycap, and electrically connected with the control unit. After a touch signal is received by the touch-sensitive circuit layer, the touch signal is transmitted to the control unit, and the touch signal is converted into an input signal by the control unit.

8 Claims, 8 Drawing Sheets

KEYBOARD DEVICE AND TOUCH KEY STRUCTURE THEREOF

FIELD OF THE INVENTION

The present invention relates to an input device, and more particularly to a keyboard device and a touch key structure of the keyboard device.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The input devices of the common electronic devices include for example mouse devices, keyboard devices, trackball devices, or the like. Via the keyboard device, texts or symbols can be inputted into the computer system directly. As a consequence, most users and most manufacturers of input devices pay much attention to the development of keyboard devices.

In recent years, with the vigorous development of touch sensing technology, more and more electronic devices are equipped with touch sensing elements and the input method is correspondingly changed. As a consequence, a touch keyboard device has been introduced into the market. In many situations, the conventional keyboard device is replaced by the touch keyboard device. The touch keyboard device is user-friendly and provides an aesthetic operating environment.

In a conventional touch keyboard device, a whole piece of touch-sensitive circuit layer is attached on the bottom surface of the keycap. However, this design may adversely affect the typing feel. Moreover, since the touch-sensitive circuit layer is not cost-effective, the competitiveness of this product pricing is not satisfied. In another conventional touch keyboard device, a whole piece of touch-sensitive circuit layer is placed on the base plate. This design can increase sensing distance and thus enhance the tactile feel of touching the key structure. Although the tactile feel of touching the key structure is enhanced, there are still some drawbacks. For example, the above two conventional keyboard devices adopt the irreversible design concepts. That is, during the process of designing the keyboard device, the region of the touch-sensitive circuit layer needs to be determined at first according to the touch control strategy (i.e., the whole-region touch control strategy or the partial-region touch control strategy). After the region of the touch-sensitive circuit layer is determined, the purpose of switching the touch-sensitive region can be achieved through the firmware control. However, this structural design cannot meet the requirements of the user. In case that the whole piece of touch-sensitive circuit layer is placed on the base plate, it is necessary to perform the jumper/insulation treatment because there are many overlap regions between the XY-matrix conductor lines. If the local insulation is not well done in the production process, the whole piece of touch-sensitive circuit layer needs to be discarded. In other words, the production yield is not satisfied.

Therefore, there is a need of providing an improved keyboard device in order to overcome the drawbacks of the conventional technologies.

SUMMARY OF THE INVENTION

The present invention provides a keyboard device with detachable touch key structures.

The present invention also provides a touch key structure that is detachably installed on a keyboard device.

The other objects and advantages of the present invention will be understood from the disclosed technical features.

In accordance with an aspect of the present invention, a keyboard device is provided. The keyboard device includes a circuit substrate, a control unit and plural touch key structures. The control unit is installed on the circuit substrate. The plural touch key structures are detachably installed on the circuit substrate. Each of the plural touch key structures includes a base plate, a keycap, a connecting element and a touch-sensitive circuit layer. The base plate is detachably installed on the circuit substrate. The keycap is located over the base plate. The connecting element is arranged between the base plate and the keycap. The keycap is movable upwardly or downwardly relative to the base plate through the connecting element. The touch-sensitive circuit layer is arranged between the base plate and the keycap, and electrically connected with the control unit. After a touch signal is received by the touch-sensitive circuit layer, the touch signal is transmitted to the control unit, and the touch signal is converted into an input signal by the control unit.

In an embodiment, the base plate has a first surface and a second surface opposed to the first surface. The first surface of the base plate faces the connecting element. The second surface of the base plate faces the circuit substrate. The touch-sensitive circuit layer is installed on the first surface of the base plate.

In an embodiment, each of the plural touch key structures further includes plural signal transmission pins. The plural signal transmission pins are protruded from the second surface of the base plate. The plural signal transmission pins are electrically connected with the touch-sensitive circuit layer. When the base plate is installed on the circuit substrate, the plural signal transmission pins are electrically connected with the control unit through the circuit substrate. Consequently, the touch-sensitive circuit layer is electrically connected with the control unit through the plural signal transmission pins.

In an embodiment, the connecting element is a butterfly-type connecting element, and the butterfly-type connecting element includes a first frame, a second frame and a frame body. The first frame and the second frame are connected between the keycap and the frame body. The first frame and the second frame are pivotally coupled to each other. While the keycap is moved upwardly or downwardly relative to the base plate, the first frame and the second frame are swung relative to each other.

In an embodiment, the connecting element is a liftable keyswitch, and the liftable keyswitch includes a pedestal and a sliding rod. The pedestal is penetrated through the base plate. The sliding rod is connected between a first end of the pedestal and the keycap. While the keycap is moved upwardly or downwardly relative to the base plate, the sliding rod is correspondingly slid relative to the pedestal.

In an embodiment, each of the plural touch key structures further includes plural signal transmission pins. The plural signal transmission pins are protruded from a second end of the pedestal and arranged between the base plate and the circuit substrate. The plural signal transmission pins are electrically connected with the touch-sensitive circuit layer. When the base plate is installed on the circuit substrate, the plural signal transmission pins are electrically connected with the control unit through the circuit substrate. Consequently, the touch-sensitive circuit layer is electrically connected with the control unit through the plural signal transmission pins.

In an embodiment, the keycap includes an upper part and a skirt part. The skirt part is protruded from the upper part in a direction toward the base plate. The upper part has a top surface and a bottom surface opposed to the top surface. The bottom surface of the upper part faces the connecting element, and the touch-sensitive circuit layer is installed on the bottom surface of the upper part.

In an embodiment, the keyboard device further includes plural non-touch key structures. The plural non-touch key structures are detachably installed on a first installation region of the circuit substrate. The plural touch key structures are detachably installed on a second installation region of the circuit substrate. The first installation region and the second installation region are not overlapped with each other.

In accordance with another aspect of the present invention, a touch key structure is provided. The touch key structure is detachably installed on a keyboard device. The keyboard device includes a circuit substrate and a control unit. The control unit is installed on the circuit substrate. The touch key structure includes a base plate, a keycap, a connecting element and a touch-sensitive circuit layer. The base plate is detachably installed on the circuit substrate. The keycap is located over the base plate. The connecting element is arranged between the base plate and the keycap. The keycap is movable upwardly or downwardly relative to the base plate through the connecting element. The touch-sensitive circuit layer is arranged between the base plate and the keycap, and electrically connected with the control unit. After a touch signal is received by the touch-sensitive circuit layer, the touch signal is transmitted to the control unit, and the touch signal is converted into an input signal by the control unit.

From the above descriptions, the present invention provides a keyboard device with touch key structures. The base plate or the keycap of each touch key structure is equipped with a touch-sensitive circuit layer. Moreover, each touch key structure is detachably installed on the circuit substrate. Due to this structural design, the user can purchase the key structures with the touch-sensitive circuit layers. In addition, the touch-sensitive regions (e.g., the areas and the distributed locations of the touch-sensitive regions) can be assembled and defined by the user. Especially, the touch-sensitive regions can be adjusted according to the use habits of the user or the application conditions. Consequently, the touch control function of the keyboard device is reversible/selectable. Since the keyboard device provides more options, the use convenience is largely increased. In addition, the touch-sensitive circuit layer is divided into plural touch-sensitive units, and the plural touch-sensitive units are distributed to respective key structures. In comparison with the complete large-area touch-sensitive circuit layer, the yield of producing the unit of the touch-sensitive circuit layer is largely increased. Consequently, the fabricating cost of the keyboard device is reduced, and the product competitiveness is enhanced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
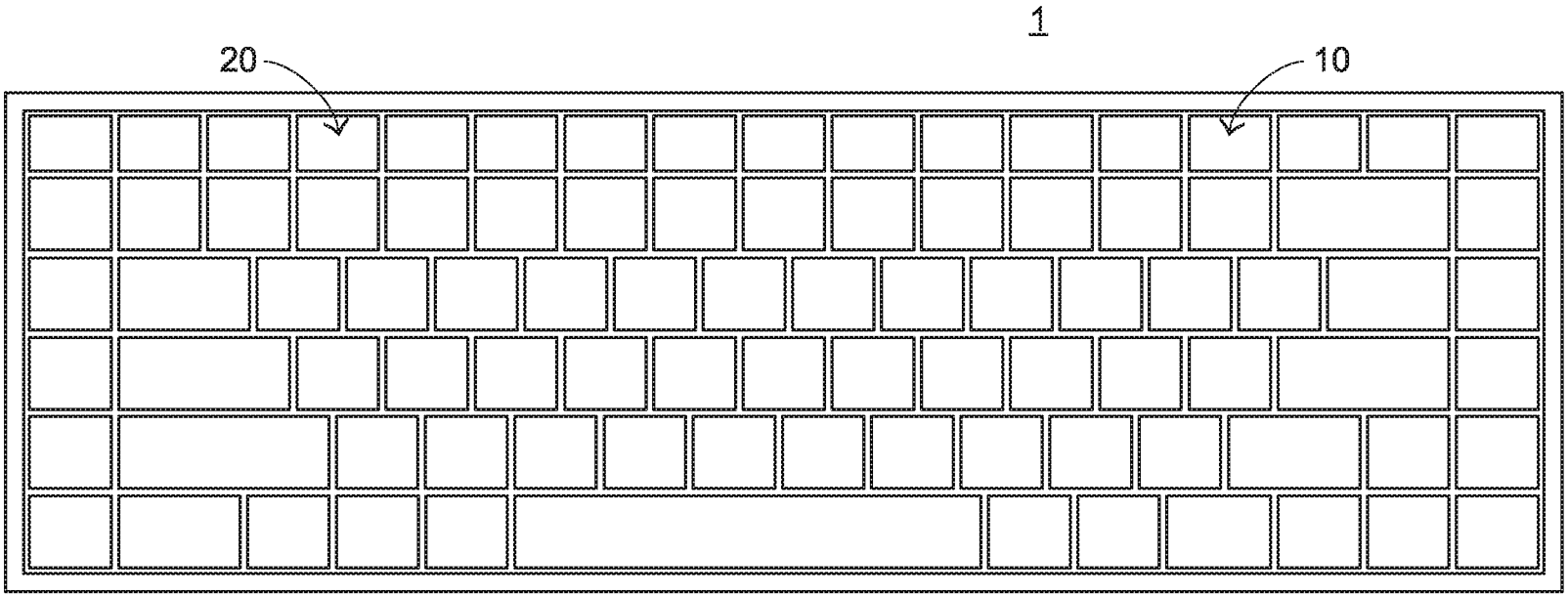
FIG. 1 is a schematic top view illustrating the appearance of a keyboard device according to a first embodiment of the present invention.
Figure 2:
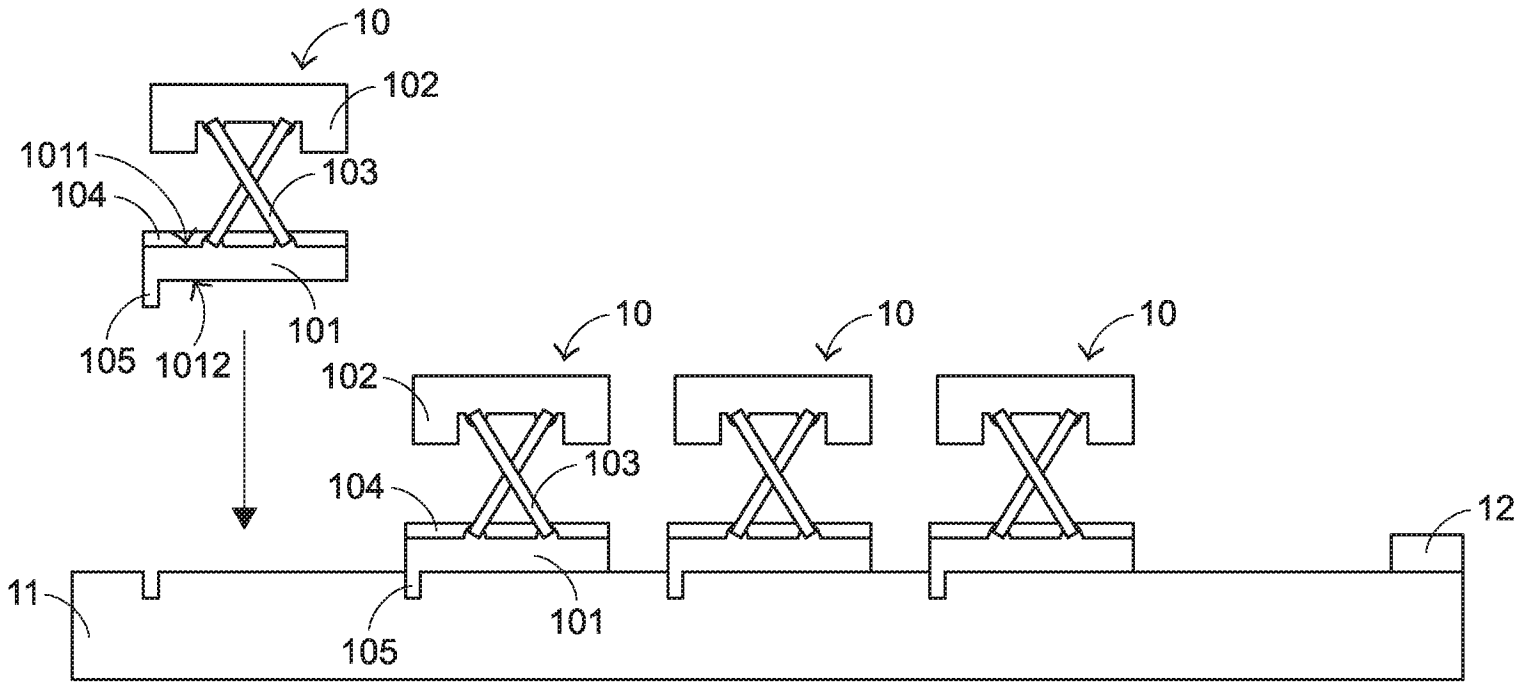
FIG. 2 schematically illustrates a process of installing a touch key structure on the keyboard device as shown in FIG. 1.
Figure 3:
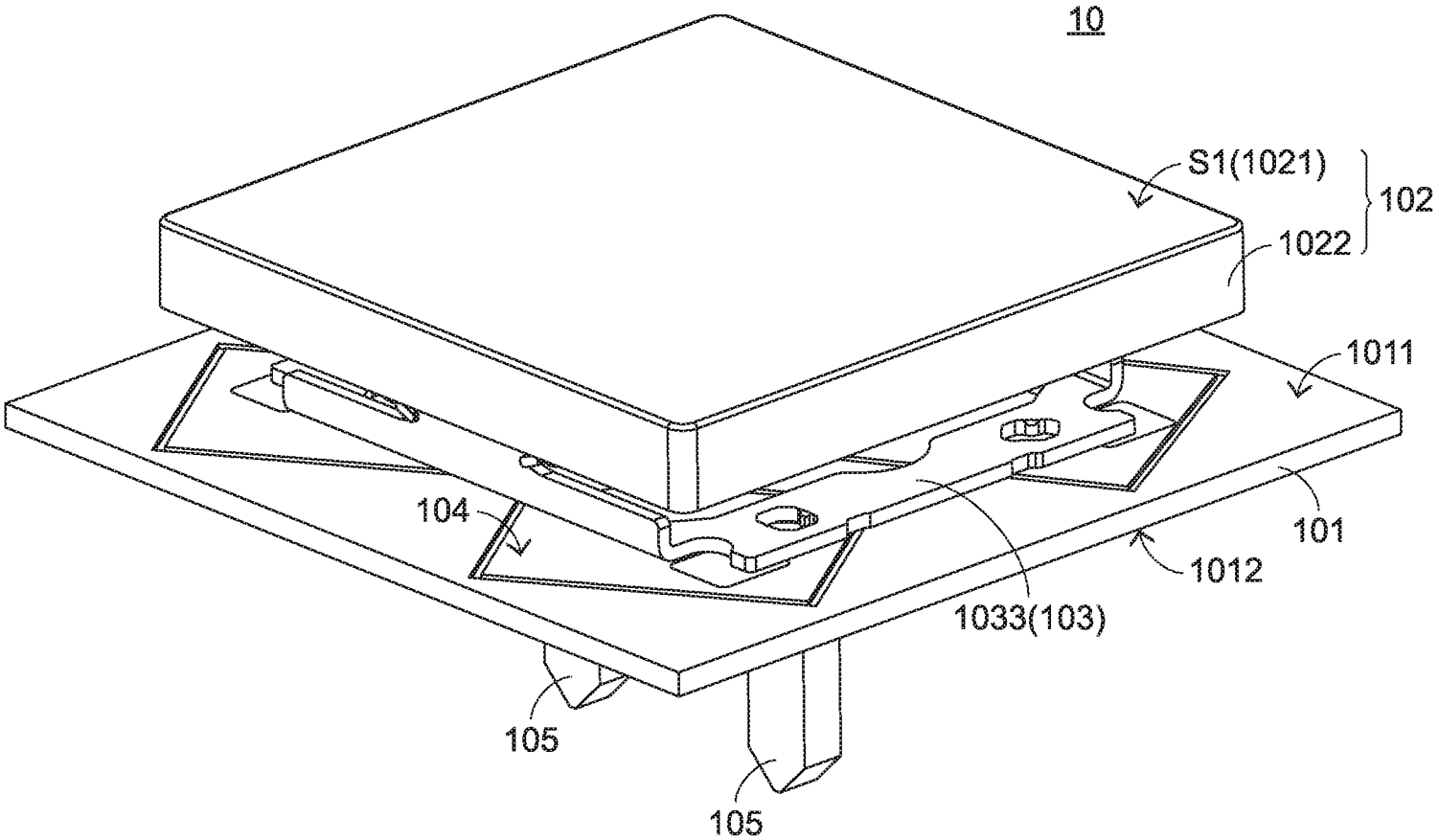
FIG. 3 is a schematic perspective view illustrating the touch key structure of the keyboard device as shown in FIG. 1.
Figure 4:
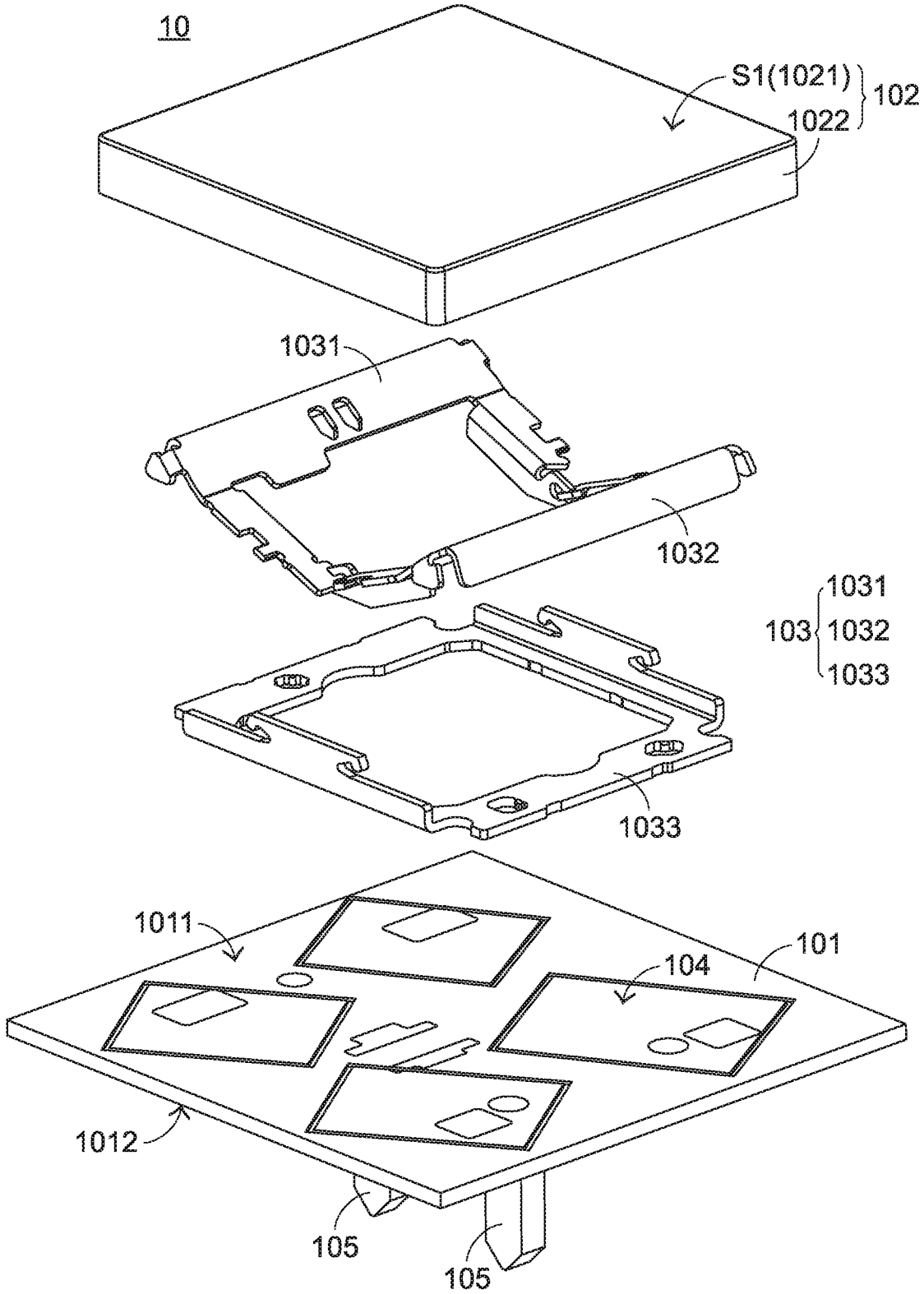
FIG. 4 is a schematic exploded view illustrating the touch key structure of the keyboard device as shown in FIG. 1.

Please refer to FIGS. 1, 2, 3 and 4. FIG. 1 is a schematic top view illustrating the appearance of a keyboard device according to a first embodiment of the present invention. FIG. 2 schematically illustrates a process of installing a touch key structure on the keyboard device as shown in FIG. 1. FIG. 3 is a schematic perspective view illustrating the touch key structure of the keyboard device as shown in FIG. 1. FIG. 4 is a schematic exploded view illustrating the touch key structure of the keyboard device as shown in FIG. 1.

As shown in FIG. 1, the keyboard device 1 comprises plural key structures. These key structures are classified into some types, e.g., ordinary keys, numeric keys and function keys. When one of the key structures is depressed by the user's finger, the keyboard device generates a corresponding key signal to a computer, and thus the computer executes a corresponding function. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

In an embodiment, these key structures include plural touch key structures 10 and plural non-touch key structures 20. All of the plural touch key structures 10 and the plural non-touch key structures 20 are detachably installed on the keyboard device 1. The numbers of the touch key structures 10 and the non-touch key structures 20 can be determined according to the use habit and the requirement of the user.

The touch key structure 10 of the keyboard device 1 will be described in more details as follows.

As shown in FIG. 2, the keyboard device 1 further comprises a circuit substrate 11 and a control unit 12. The control unit 12 is installed on the circuit substrate 11. These touch key structures 10 are detachably installed on the circuit substrate 11. Preferably but not exclusively, the control unit 12 is a touch IC chip. For clearly illustrating the process of installing the touch key structure 10 on the circuit substrate 11, the appearance of the touch key structure 10 as shown in FIG. 2 is somewhat different from the appearance of the touch key structure 10 as shown in the other drawings. However, the functions of the components of the touch key structure 10 as shown in FIG. 2 are identical to those of the touch key structure 10 as shown in the other drawings.

Please refer to FIGS. 2 and 4. In an embodiment, the touch key structure 10 comprises a base plate 101, a keycap 102, a connecting element 103 and a touch-sensitive circuit layer 104. The base plate 101 is detachably installed on the circuit substrate 11. The keycap 102 is located over the base plate 101. The connecting element 103 is arranged between the base plate 101 and the keycap 102. The keycap 102 is movable upwardly or downwardly relative to the base plate 101 through the connecting element 103. The touch-sensitive circuit layer 104 is arranged between the base plate 101 and the keycap 102. In addition, the touch-sensitive circuit layer 104 is electrically connected with the control unit 12. After a touch signal is generated the touch signal is received by the touch-sensitive circuit layer 104 and transmitted to the control unit 12. After the touch signal is received by the control unit 12, the touch signal is converted into an input signal.

Please refer to FIGS. 2, 3 and 4. The base plate 101 has a first surface 1011 and a second surface 1012, which are opposed to each other. The first surface 1011 of the base plate 101 faces the connecting element 103. The second surface 1012 of the base plate 101 faces the circuit substrate 11. In this embodiment, the touch-sensitive circuit layer 104 is installed on the first surface 1011 of the base plate 101. That is, the touch-sensitive circuit layer 104 is installed on the base plate 101 of the corresponding touch key structure 10. In addition, all touch key structures 10 are detachably installed on the circuit substrate 11. Due to this structural design, the areas of the touch-sensitive regions and the distributed locations of these touch-sensitive regions can be assembled and defined by the user.

Please refer to FIGS. 2, 3 and 4 again. The touch key structure 10 further comprises plural signal transmission pins 105. The plural signal transmission pins 105 are protruded from the second surface 1012 of the base plate 101. In addition, these signal transmission pins 105 are electrically connected with the touch-sensitive circuit layer 104, which is installed on the first surface 1011 of the base plate 101. When the touch key structure 10 is installed on the circuit substrate 11 through the base plate 101, these signal transmission pins 105 are electrically connected with the control unit 12 through the circuit substrate 11. Consequently, the touch-sensitive circuit layer 104 is electrically connected with the control unit 12 through these signal transmission pins 105.

Please refer to FIGS. 2, 3 and 4 again. In an embodiment, the connecting element 103 is a butterfly-type connecting element. It is noted that the example of the connecting element 103 is not restricted. For example, in another embodiment, the connecting element 103 is a scissors-type connecting element or any other appropriate connecting element. In this embodiment, the butterfly-type connecting element 103 comprises a first frame 1031, a second frame 1032 and a frame body 1033. The first frame 1031 and the second frame 1032 of the butterfly-type connecting element 103 are arranged between the keycap 102 and the frame body 1033. In addition, the first frame 1031 and the second frame 1032 are pivotally coupled to each other. While the keycap 102 is moved upwardly or downwardly relative to the base plate 101, the first frame 1031 and the second frame 1032 of the butterfly-type connecting element 103 are swung relative to each other.

Figure 5A:
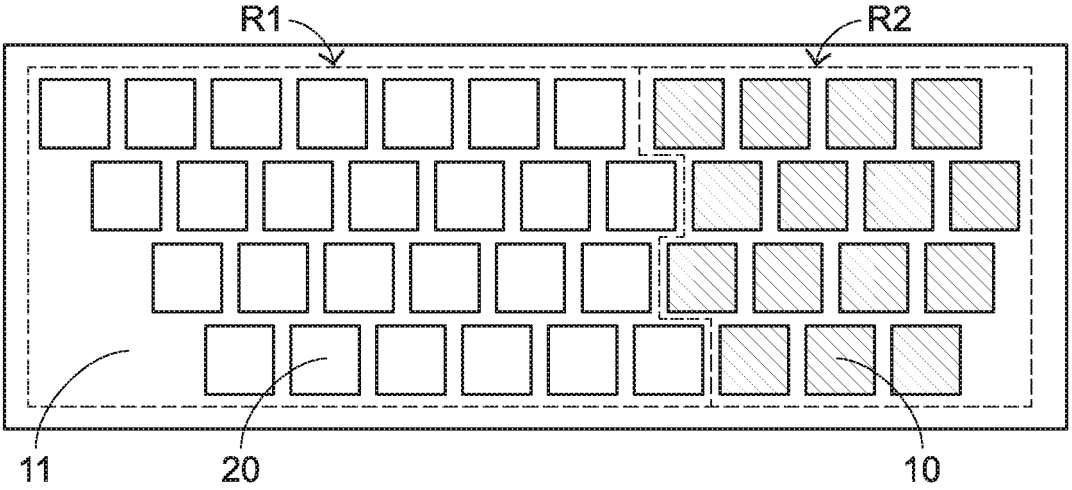
FIG. 5A is a schematic top view illustrating an arrangement of plural touch key structures of the keyboard device as shown in FIG. 1.
Figure 5B:
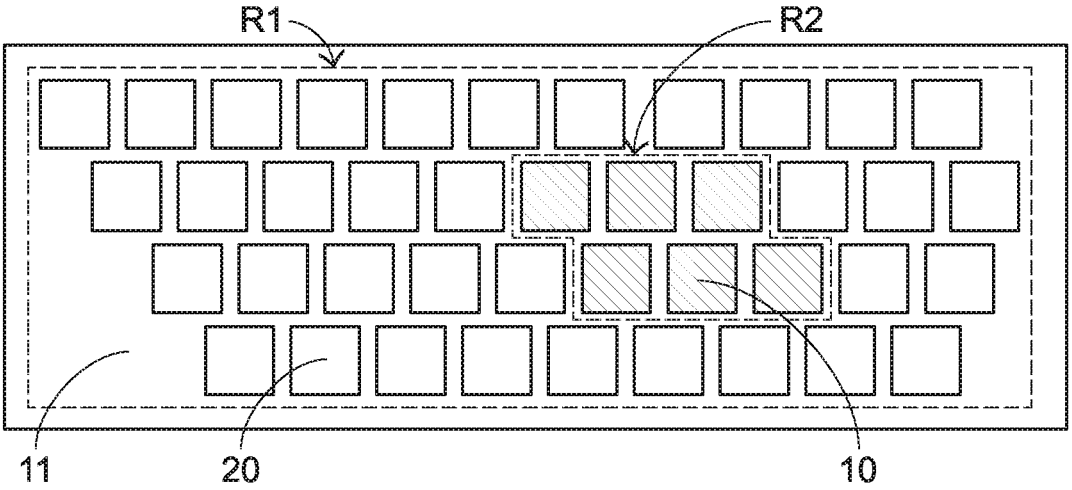
FIG. 5B is a schematic top view illustrating another arrangement of plural touch key structures of the keyboard device as shown in FIG. 1.

Please refer to FIGS. 5A and 5B. FIG. 5A is a schematic top view illustrating an arrangement of plural touch key structures of the keyboard device as shown in FIG. 1. FIG. 5B is a schematic top view illustrating another arrangement of plural touch key structures of the keyboard device as shown in FIG. 1.

In an embodiment, the distributed locations of the touch-sensitive regions can be defined according to the use habits of the user or the application conditions. As shown in FIG. 5A, the non-touch key structures 20 and the touch key structures 10 are installed on a left side and a right side of the circuit substrate 11, respectively. That is, the non-touch key structures 20 are installed on the left side of the circuit substrate 11 (e.g., a first installation region R1), and the touch key structures 10 are installed on the right side of the circuit substrate 11 (e.g., a second installation region R2). It is noted that arrangements of the non-touch key structures 20 and the touch key structures 10 are not restricted. For example, in another embodiment, the touch key structures 10 are installed on the left side of the circuit substrate 11 (e.g., the first installation region R1), and the non-touch key structures 20 are installed on the right side of the circuit substrate 11 (e.g., the second installation region R2). The first installation region R1 and the second installation region R2 are not overlapped with each other.

In another embodiment, the areas of these touch-sensitive regions can be defined according to the use habits of the user or the application conditions. As shown in FIG. 5B, the non-touch key structures 20 are installed on a larger-area touch-sensitive region (e.g., a first installation region R1), and the touch key structures 10 are installed on a smaller-area touch-sensitive region (e.g., a second installation region R2). It is noted that arrangements of the non-touch key structures 20 and the touch key structures 10 are not restricted. For example, in another embodiment, the touch key structures 10 are installed on the larger-area touch-sensitive region (e.g., the first installation region R1), and the non-touch key structures 20 are installed on the smaller-area touch-sensitive region (e.g., the second installation region R2). The first installation region R1 and the second installation region R2 are not overlapped with each other.

Figure 6:
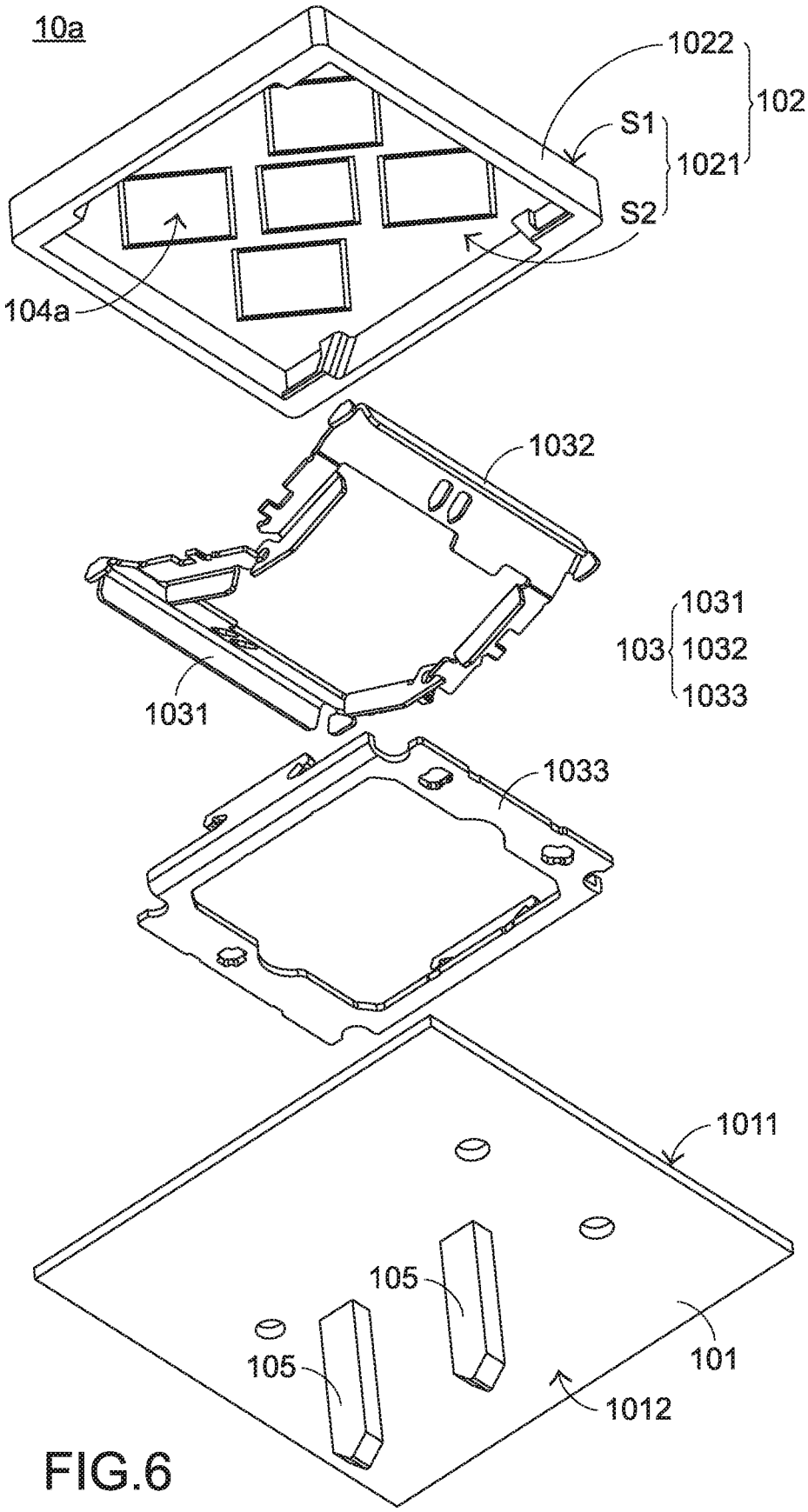
FIG. 6 is a schematic exploded view illustrating a touch key structure according to another embodiment of the present invention.

FIG. 6 is a schematic exploded view illustrating a touch key structure according to another embodiment of the present invention. In comparison with the touch key structure 10 as shown in FIGS. 1, 2, 3 and 4, the installation position of the touch-sensitive circuit layer 104*a* in the touch key structure 10*a* of this embodiment is distinguished. In this embodiment, the touch-sensitive circuit layer 104*a* is installed on the keycap 102. The keycap 102 comprises an upper part 1021 and a skirt part 1022. The skirt part 1022 is protruded from the peripheral region of the upper part 1021 in the direction toward the base plate 101. The upper part 1021 has a top surface S1 and a bottom surface S2, which are opposed to each other. The bottom surface S2 of the upper part 1021 faces the connecting element 103. In this embodiment, the touch-sensitive circuit layer 104*a* is installed on the bottom surface S2 of the upper part 1021 of the keycap 102. The other components of the touch key structure 10*a* and the relationships between the components of the touch key structure 10*a* are similar to those of the touch key structure 10 as shown in FIGS. 1, 2, 3 and 4, and not redundantly described herein. When the touch-sensitive circuit layer 104*a* is installed on the bottom surface S2 of the upper part 1021 of the keycap 102, the touch-sensitive circuit layer 104*a* can be electrically connected with the signal transmission pins 105 on the second surface 1012 of the base plate 101 through corresponding conducting lines (not shown).

Figure 7:
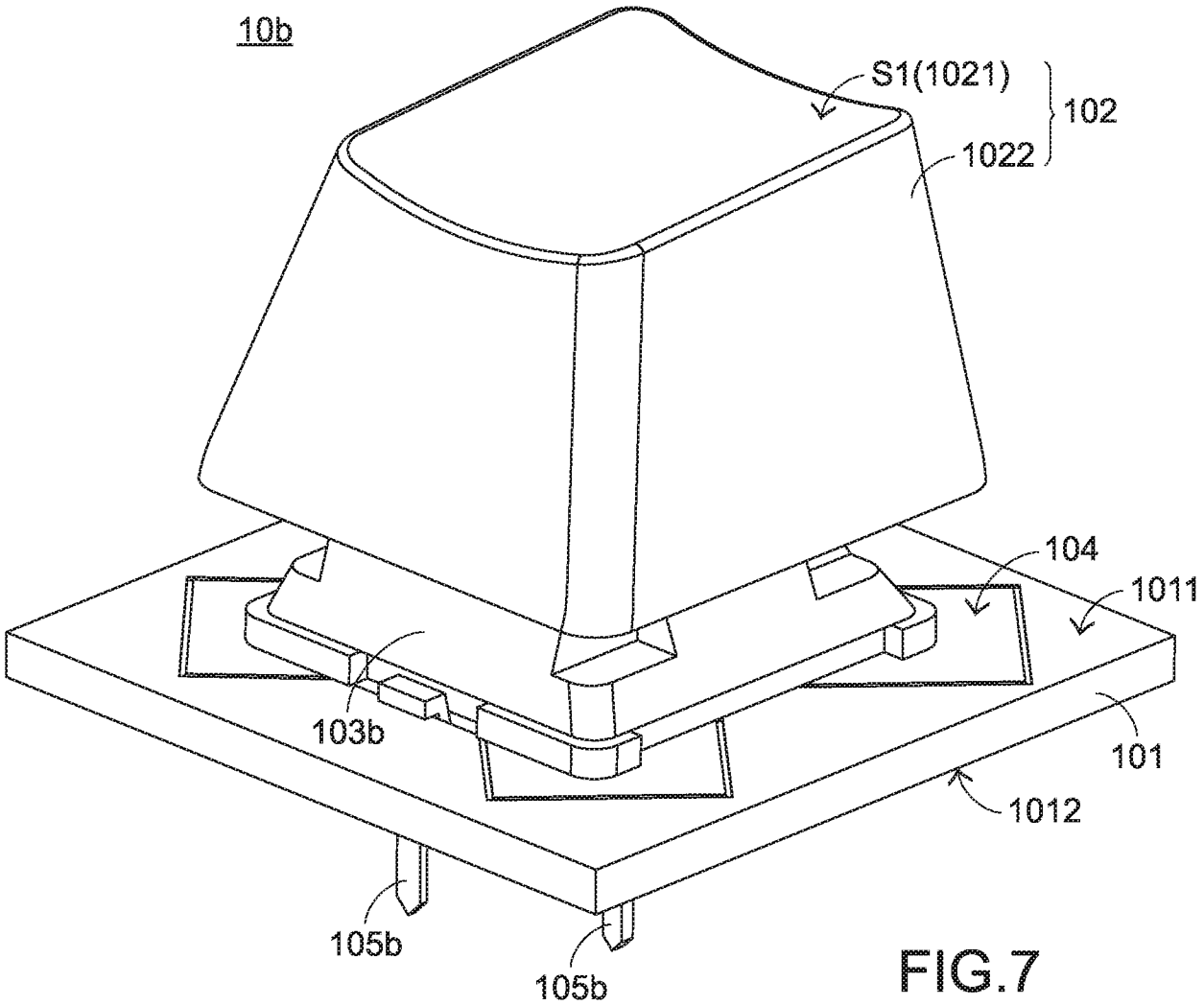
FIG. 7 is a schematic perspective view illustrating a touch key structure according to a further embodiment of the present invention.
Figure 8:
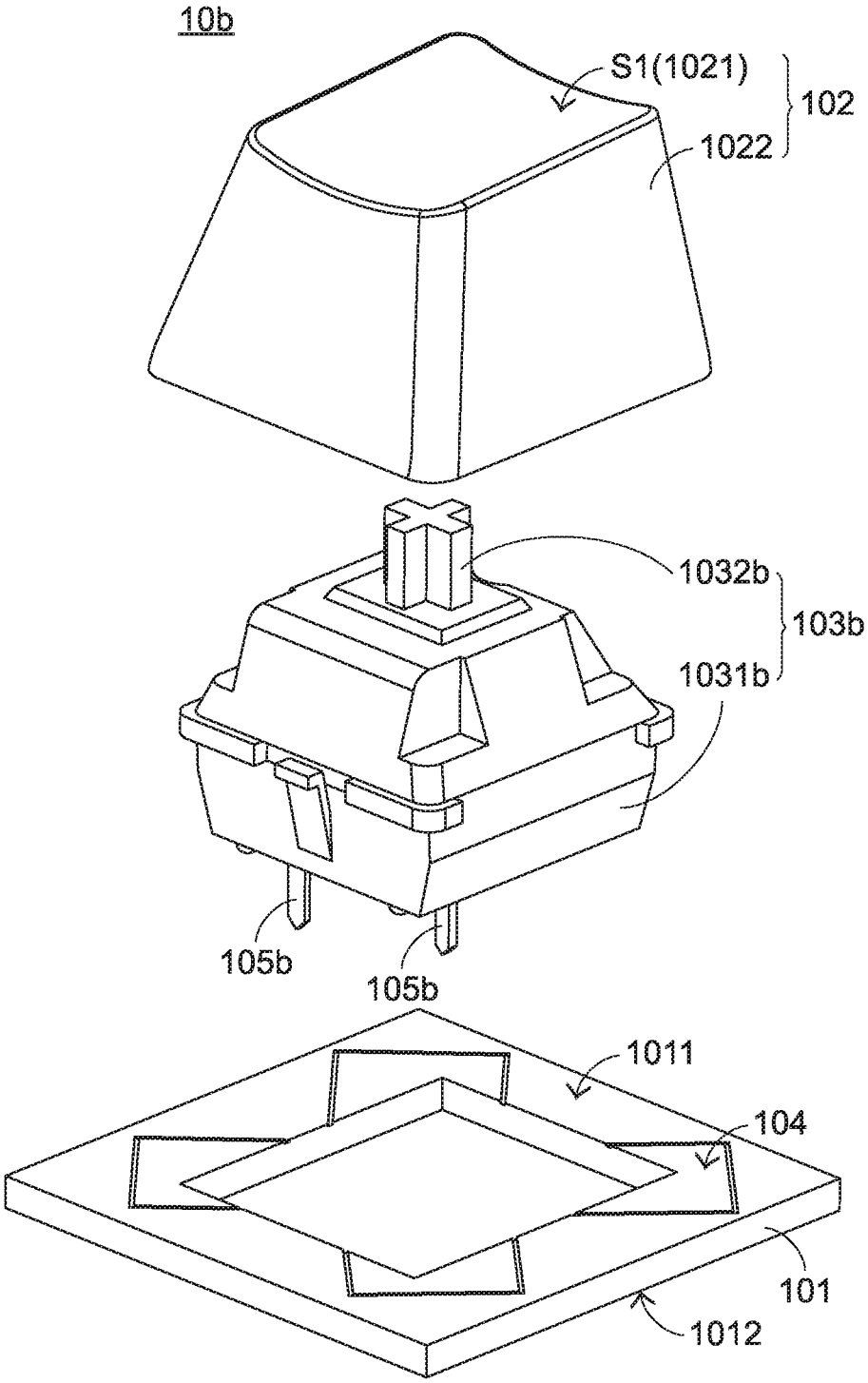
FIG. 8 is a schematic exploded view illustrating the touch key structure as shown in FIG. 7.

Please refer to FIGS. 7 and 8. FIG. 7 is a schematic perspective view illustrating a touch key structure according to a further embodiment of the present invention. FIG. 8 is a schematic exploded view illustrating the touch key structure as shown in FIG. 7. In comparison with the touch key structure 10 as shown in FIGS. 1, 2, 3 and 4, the connecting element 103*b* in the touch key structure 10*b* of this embodiment is distinguished. In this embodiment, the connecting element 103*b* is a liftable keyswitch. The liftable keyswitch comprises a pedestal 1031*b* and a sliding rod 1032*b*. The pedestal 1031*b* of the liftable keyswitch is penetrated through the base plate 101. The sliding rod 1032*b* is connected between a first end of the pedestal 1031*b* (i.e., the end of the pedestal 1031*b* close to the keycap 102) and the keycap 102. While the keycap 102 is moved upwardly or downwardly relative to the base plate 101, the sliding rod 1032*b* is correspondingly slid relative to the pedestal 1031*b*. Preferably but not exclusively, the liftable keyswitch is a blue keyswitch, a brown keyswitch, a black keyswitch a red keyswitch or any other appropriate keyswitch that is used in the general mechanical key structure.

As shown in FIGS. 7 and 8, the touch key structure 10*b* of this embodiment comprises plural signal transmission pins 105*a*. These signal transmission pins 105*a* are protruded from a second end of the pedestal 1031*b* (i.e., the end of the pedestal 1031*b* close to the circuit substrate 11). In addition, these signal transmission pins 105*a* are arranged between the base plate 101 and the circuit substrate 11. Moreover, these signal transmission pins 105*a* are electrically connected with the touch-sensitive circuit layer 104, which is installed on the first surface 1011 of the base plate 101. When the touch key structure 10*b* is installed on the circuit substrate 11 through the base plate 101, these signal transmission pins 105*b* are electrically connected with the control unit 12 through the base plate 101. Consequently, the touch-sensitive circuit layer 104 is electrically connected with the control unit 12 through these signal transmission pins 105*b*.

The other components of the touch key structure 10*b* and the relationships between the components of the touch key structure 10*b* are similar to those of the touch key structure 10 as shown in FIGS. 1, 2, 3 and 4, and not redundantly described herein. It is noted that the touch key structure 10*b* may be modified. For example, the concepts of the touch key structure 10*a* as shown in FIG. 6 can be applied to the touch key structure 10*b*. That is, the touch-sensitive circuit layer 104 is installed on the bottom surface S2 of the upper part 1021 of the keycap 102. When the touch-sensitive circuit layer 104 is installed on the bottom surface S2 of the upper part 1021 of the keycap 102, the touch-sensitive circuit layer 104 can be electrically connected with the signal transmission pins 105*b* on the second end of the pedestal 1031*b* through corresponding conducting lines (not shown) and the sliding rod 1032*b* of the liftable keyswitch.

From the above descriptions, the present invention provides a keyboard device with touch key structures. The base plate or the keycap of each touch key structure is equipped with a touch-sensitive circuit layer. Moreover, each touch key structure is detachably installed on the circuit substrate. Due to this structural design, the user can purchase the key structures with the touch-sensitive circuit layers. In addition, the touch-sensitive regions (e.g., the areas and the distributed locations of the touch-sensitive regions) can be assembled and defined by the user. Especially, the touch-sensitive regions can be adjusted according to the use habits of the user or the application conditions. Consequently, the touch control function of the keyboard device is reversible/selectable. Since the keyboard device provides more options, the use convenience is largely increased. In addition, the touch-sensitive circuit layer is divided into plural touch-sensitive units, and the plural touch-sensitive units are distributed to respective key structures. In comparison with the complete large-area touch-sensitive circuit layer, the yield of producing the unit of the touch-sensitive circuit layer is largely increased. Consequently, the fabricating cost of the keyboard device is reduced, and the product competitiveness is enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard device, comprising:

a circuit substrate;

a control unit installed on the circuit substrate; and plural touch key structures detachably installed on the circuit substrate, wherein each of the plural touch key structures comprises:

a base plate detachably installed on the circuit substrate;

a keycap located over the base plate;

a connecting element is arranged between the base plate and the keycap, wherein the keycap is movable upwardly or downwardly relative to the base plate through the connecting element; and a touch-sensitive circuit layer arranged between the base plate and the keycap, and electrically connected with the control unit, wherein after a touch signal is received by the touch-sensitive circuit layer, the touch signal is transmitted to the control unit, and the touch signal is converted into an input signal by the control unit.

2. The keyboard device according to claim 1, wherein the base plate has a first surface and a second surface opposed to the first surface, wherein the first surface of the base plate faces the connecting element, the second surface of the base plate faces the circuit substrate, and the touch-sensitive circuit layer is installed on the first surface of the base plate.

3. The keyboard device according to claim 2, wherein each of the plural touch key structures further comprises plural signal transmission pins, wherein the plural signal transmission pins are protruded from the second surface of the base plate, and the plural signal transmission pins are electrically connected with the touch-sensitive circuit layer, wherein when the base plate is installed on the circuit substrate, the plural signal transmission pins are electrically connected with the control unit through the circuit substrate, so that the touch-sensitive circuit layer is electrically connected with the control unit through the plural signal transmission pins.

4. The keyboard device according to claim 1, wherein the connecting element is a butterfly-type connecting element, and the butterfly-type connecting element comprises a first frame, a second frame and a frame body, wherein the first frame and the second frame are connected between the keycap and the frame body, and the first frame and the second frame are pivotally coupled to each other, wherein while the keycap is moved upwardly or downwardly relative to the base plate, the first frame and the second frame are swung relative to each other.

5. The keyboard device according to claim 1, wherein the connecting element is a liftable keyswitch, and the liftable keyswitch comprises a pedestal and a sliding rod, wherein the pedestal is penetrated through the base plate, and the sliding rod is connected between a first end of the pedestal and the keycap, wherein while the keycap is moved upwardly or downwardly relative to the base plate, the sliding rod is correspondingly slid relative to the pedestal.

6. The keyboard device according to claim 5, wherein each of the plural touch key structures further comprises plural signal transmission pins, wherein the plural signal transmission pins are protruded from a second end of the pedestal and arranged between the base plate and the circuit substrate, and the plural signal transmission pins are electrically connected with the touch-sensitive circuit layer, wherein when the base plate is installed on the circuit substrate, the plural signal transmission pins are electrically connected with the control unit through the circuit substrate, so that the touch-sensitive circuit layer is electrically connected with the control unit through the plural signal transmission pins.

7. The keyboard device according to claim 1, wherein the keycap comprises an upper part and a skirt part, wherein the skirt part is protruded from the upper part in a direction toward the base plate, and the upper part has a top surface and a bottom surface opposed to the top surface, wherein the bottom surface of the upper part faces the connecting element, and the touch-sensitive circuit layer is installed on the bottom surface of the upper part.

8. The keyboard device according to claim 1, wherein the keyboard device further comprises plural non-touch key structures, wherein the plural non-touch key structures are detachably installed on a first installation region of the circuit substrate, the plural touch key structures are detachably installed on a second installation region of the circuit substrate, wherein the first installation region and the second installation region are not overlapped with each other.

* * * * *